United States Patent [19]

Iiyama et al.

[11] Patent Number: 4,517,580

[45] Date of Patent: May 14, 1985

[54] THERMOSENSITIVE RECORDING MATERIAL

[75] Inventors: Kiyotaka Iiyama, Mishima; Keishi Taniguchi, Shizuoka, both of Japan

[73] Assignee: Ricoh Company, Ltd., Tokyo, Japan

[21] Appl. No.: 568,847

[22] Filed: Jan. 6, 1984

[30] Foreign Application Priority Data

Jan. 19, 1983 [JP] Japan ..... 58-6897

[51] Int. Cl.[3] ..... B41M 5/18; B41M 5/22

[52] U.S. Cl. ..... 346/214; 346/216; 346/217; 346/225; 346/226; 428/342; 428/913; 428/914

[58] Field of Search ..... 346/214, 216, 217, 225, 346/226; 428/340–342, 913, 914

[56] References Cited

U.S. PATENT DOCUMENTS 2,813,042 11/1957 Gordon et al. ..... 346/225

3,442,682 5/1969 Fukawa ..... 346/217

4,421,344 12/1983 Ikezawa et al. ..... 428/328

*Primary Examiner*—Bruce H. Hess

*Attorney, Agent, or Firm*—Flynn, Thiel, Boutell & Tanis

[57] ABSTRACT

A thermosensitive recording material comprising a support material and a thermosensitive coloring layer formed thereon, in which thermosensitive coloring layer, colored images are formed by the reaction between a colorless or light-colored leuco dye and a color-developer of the following formula capable of inducing color formation in the leuco dye upon application of heat thereto,

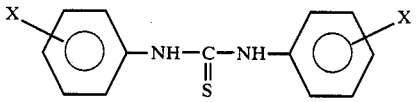

wherein X indicates halogen.

9 Claims, No Drawings

THERMOSENSITIVE RECORDING MATERIAL

BACKGROUND OF THE INVENTION

The present invention relates to an improved thermosensitive recording material comprising a support material and a thermosensitive coloring layer formed thereon, which thermosensitive coloring layer comprises a colorless or light-colored leuco dye and a color-developer which induces color information in the leuco dye when heat is applied thereto. More particularly, it relates to a thermosensitive recording material of the above-mentioned type in which as the color developer a particular thiourea derivative is employed.

A conventional thermosensitive recording material comprises a support material, such as paper, synthetic paper or a plastic film, and a thermosensitive coloring layer formed thereon which consists essentially of a composition which is colored upon application of heat thereto. On the thermosensitive recording material, colored images are formed by application of heat by use of a thermal head or a thermal pen, or by application of laser beams thereto. Recording materials of this kind are widely used for making copies from books and documents or as output charts for computers and facsimile apparatus, tickets for vending machines, labels and other charts for recording, since in comparison with other recording materials, they have the advantages that complex steps for recording, such as development and image fixing, are unnecessary, recorded images can be quickly obtained by a comparatively simple apparatus, no noise is generated during operation, and they are free from a problem of air pollution and cheaper than other recording materials. A thermosensitive composition for color formation employed in such a thermosensitive recording material is generally composed of a coloring agent and a color developer which is capable of inducing color formation in the coloring agent upon application of the heat thereto.

As the coloring agent, for example, colorless or light-colored leuco dyes having lactone rings, lactam rings or spyropyran rings are employed.

As the color-developer, a wide variety of acidic materials such as organic acids and phenolic materials are employed. The recording materials in which such a coloring agent and a color developer are used in combination have the advantages that the color tone of the images is clear, the whiteness of the background is high and the images are excellent in weathering resistance. Therefore they are widely used.

Recently other conventional recording systems are being replaced by the thermosensitive recording systems and a demand for the thermosensitive recording systems is increasing. In accordance with this trend, further improvement of the quality of the thermosensitive recording materials for use with the thermosensitive recording systems is desired. In particular, a thermosensitive recording material which is resistant to oils and finger prints is desired. As the materials which have effects on the quality of the thermosensitive recording materials, there are a coloring agent, a color-developer, a binder agent which binds or protects the coloring agent and the color developer, and other additives such as a dispersing agent and a pigment. Of the above-mentioned agents, the color developer has the most significant effect on the quality of the thermosensitive recording materials.

As a conventional color-developer, Bisphenol A is in general use, since its color development performance is excellent. Bisphenol A, however, has the shortcoming that images developed by Bisphenol A fade or disappear, upon coming into contact with oils, such as olive oil or salad oil, and are also vulnerable to finger prints. This shortcoming of Bisphenol A is known to those who are skilled in this art.

SUMMARY OF THE INVENTION

It is therefore an object of the present invention to provide a thermosensitive recording material which is improved with respect to the stability of the thermally formed images thereon, more specifically, with the images being resistant to finger prints, oils and chemicals such as plasticizers and alcohols, and the high image density thereof being maintained for a much longer period of time in comparison with the conventional thermosensitive materials.

This object of the present invention is attained by a thermosensitive recording material comprising a support material and a thermosensitive coloring layer formed thereon, in which thermosensitive coloring layer, colored images are formed by the reaction between a colorless or light-colored leuco dye and a color-developer of the following formula (1) capable of inducing color formation in the leuco dye upon application of heat thereto,

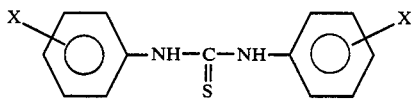

(1)

wherein X indicates halogen.

DETAILED DESCRIPTION OF THE PREFERRED EMBODIMENTS

Specific examples of the color-developer of the above general formula (1) for use in the present invention are as follows:

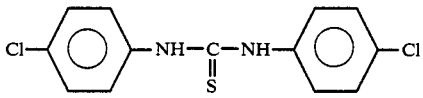

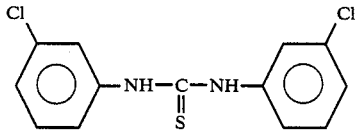

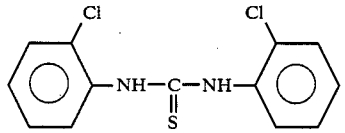

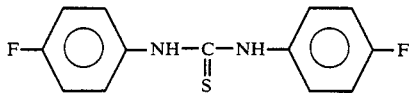

-continued

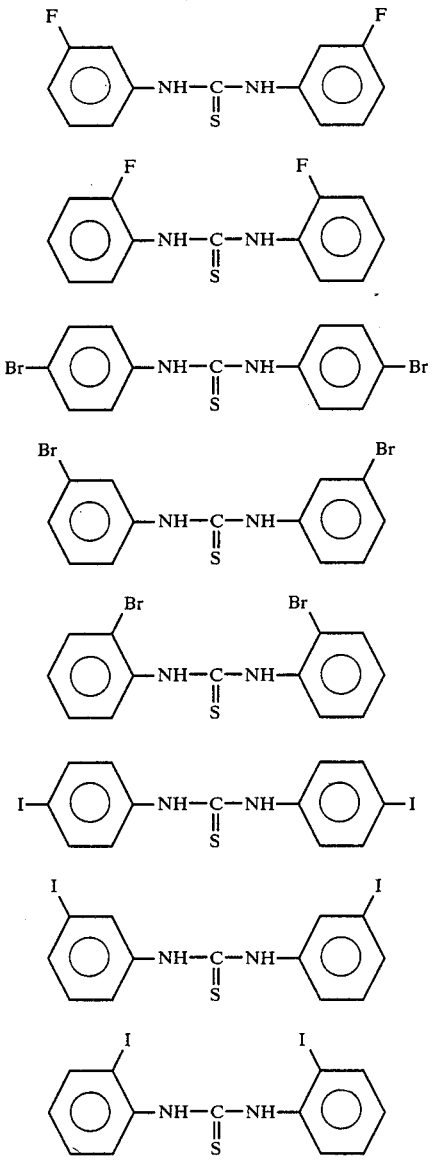

The color developers represented by the general formula (1) have powerful color development performance, probably because there exist active hydrogen atoms in the amino groups.

The color developers for use in the present invention can be used alone or in combination. To the color developers for use in the present invention, there can be added conventionally employed phenolic color developing materials and carboxylic acid color developers.

The thermosensitive recording materials according to the present invention can be used in the form of an image-transfer type recording material consisting of a transfer sheet with an image-transfer layer thereon containing the above-mentioned leuco dye and an image receiving sheet with an image receiving layer thereon containing the above-mentioned color developer.

In the image-transfer type recording material, it is preferable that the leuco dye and the color developer be respectively applied to each support material with a deposition of 0.3 g/m$^2$ to 50 g/m$^2$ when dried, more preferably, with a deposition of about 0.5 g/m$^2$ to about 30 g/m$^2$ when dried.

The color developers for use in the present invention can be synthesized by a general method as described, for instance, in a text book of experimental organic chemistry "Gatterman Wieland".

The colorless or light-colored leuco dyes which are employed as a coloring agent in the present invention can be used alone or in combination. Examples of the leuco dyes are triphenylmethane-type leuco compounds, fluoran-type leuco compounds, phenothiazine-type leuco compounds, auramine-type leuco compounds and spyropyran-type leuco compounds. Specific examples of the leuco compounds are as follows.

3,3-bis(p-dimethylaminophenyl)-6-dimethylaminophthalide (Crystal Violet),
3,3-bis(p-dimethylaminophenyl)phthalide,
3,3-bis(p-dimethylaminophenyl)-6-diethylaminophthalide,
3,3-bis(p-dimethylaminophenyl)-6-chlorophthalide,
3-(N-p-tolyl-N-ethylamino)-6-methyl-7-(N-phenylamino) fluoran,
3-diethylamino-7-chlorofluoran,
benzoyl leuco methylene blue,
6'-chloro-8'-methoxy-indolino-benzospiropyran,
6'-bromo-3'-methoxy-indolino-benzospiropyran, and
2-[3,6-bis(diethylamino)-9-(o-chloroanilino)] xanthylbenzoic acid lactam In the thermosensitive coloring layer of the thermosensitive recording material according to the present invention, in addition to the coloring agent and the color developer, a binder agent is also added. As the binder agent for use in the present invention, any conventional binder agents for use in the field of thermosensitive recording materials can be employed. In particular, the following are suitable for use in the present invention: gelatin, starch, hydroxylethylcellulose, polyacrylic acid, polycarboxyethylcellulose, methoxy cellulose, polyvinyl alcohol and polyvinyl pyrrolidone.

A thermosensitive recording material according to the present invention can be prepared by applying to a support material, such as paper or synthetic paper, a thermosensitive coloring layer formation liquid consisting essentially of the leuco dye, the color developer of the above-mentioned general formula (1) and the binder agent, followed by drying and applied layer. In the thermosensitive coloring layer, it is preferable that the amount of the leuco dye be in the range of 5 wt. % to 30 wt. %, the amount of the color developer be in the range of 40 wt. % to 80 wt. %, and the amount of the binder agent be in the range of 2 wt. % to 20 wt. %. Furthermore, it is preferable that the amount of the deposition of the thermosensitive coloring layer be in the range of 2 g/m$^3$ to 10 g/m$^2$. For smooth application of the thermosensitive coloring layer formation liquid to the support material and for better thermal recording, additives such as talc, waxes, surface active agents and deforming agents can be added to the thermosensitive coloring layer formation liquid.

When the previously mentioned image-transfer-type thermosensitive recording material is prepared, the components necessary for forming an image transfer layer and the components necessary for forming an image receiving layer are separately dispersed together with a solvent such as water in a ball mill or in an attritor as will be described more specifically, whereby an image transfer layer formation liquid and an image receiving layer formation liquid are prepared and are then applied to each support material, with a deposition of about 0.3 g/m$^2$ to 30 g/m$^2$ when dried, so that the image-transfer-type thermosensitive recording material is prepared.

When thermal image transfer is conducted by use of the image-transfer-type recording material having an image-like image transfer layer, the acceptor sheet is superimposed on the image transfer layer, and the image transfer sheet and the acceptor sheet are caused to pass, for instance, between a pair of heat application rollers. When the image transfer sheet has no image-like image transfer layer, but it has a solid image transfer layer on the entire surface thereof, the acceptor sheet is closely superimposed on the image transfer layer of the image transfer sheet, and the direct thermal printing is conducted by use of a thermal printer from the back side of the image transfer sheet.

Embodiments of a thermosensitive recording material according to the present invention will now be explained in detail by referring to the following examples:

EXAMPLE 1

Preparation of Liquid A

A mixture of the following components was dispersed in a ball mill for 20 hours, whereby Liquid A was prepared.

| | Parts by Weight |
|---|---|
| 3-(N—methyl-N—cyclohexylamine)-6-methyl-7-anilinofluoran | 10 |
| 10% aqueous solution of hydroxyethylcellulose | 10 |
| Water | 30 |

Preparation of Liquid B

A mixture of the following components was dispersed in a ball mill for 20 hours, whereby Liquid B was prepared.

| | Parts by Weight |
|---|---|
| 1,3-di(m-chlorophenyl)thiourea | 30 |
| 10% aqueous solution of hydroxyethylcellulose | 90 |

Preparation of Liquid C

A mixture of the following components was dispersed in a ball mill for 10 hours, whereby Liquid C was prepared.

| | Parts by Weight |
|---|---|
| Calcium carbonate | 40 |
| Stearamide | 15 |
| Zinc Stearate | 5 |
| 10% aqueous solution of polyvinyl alcohol | 60 |
| Water | 180 |

By mixing the Liquid A, Liquid B and Liquid C, a thermosensitive coloring layer formation liquid was prepared. This liquid was applied to a sheet of high quality paper with a base weight of 50 g/m$^2$ and was then dried to form a thermosensitive coloring layer theron with a deposition of 6 g/m$^2$ when dried, whereby a thermosensitive recording material No. 1 according to the present invention was prepared.

The thus prepared thermosensitive recording material No. 1 was subjected to an image formation test for measuring the maximum image density and the background density, an oil resistance test for inspecting the resistance of the images to an oil, and a finger print resistance test for inspecting the resistance of the images to finger prints.

In the image formation test, images are formed on the recording material No. 1 by use of a commercially available heat gredient test apparatus at 120° C. and the image density of the formed images and the background density were measured by use of a Macbeth densitometer.

In the oil resistance test, cotton seed oil was thinly applied to the images on the recording material. The recording material was then allowed to stand at 60° C. for one day and the change in the image density was visually inspected.

In the finger print resistance test, a finger print was formed on the images on the recording material by bringing a finger into pressure contact with the recording material. The recording material was then allowed to stand at 60° C. for one day and the change in the image density was visually inspected. The results are shown in Table 1.

EXAMPLE 2

Example 1 was repeated except that the color developing material, 1,3-di(m-chlorophenyl)thiourea, in the Liquid B employed in Example 1 was replaced by 1,3-di(p-chlorophenyl)thiourea, whereby a thermosensitive recording material No. 2 according to the present invention was prepared.

The thermosensitive recording material No. 2 was subjected to the same tests as those in Example 1. The results are shown in Table 1.

COMPARATIVE EXAMPLE 1

Example 1 was repeated except that the color developing material, 1,3-di(m-chlorophenyl)thiourea, in the Liquid B employed in Example 1 was replaced by Bisphenol A, whereby a comparative thermosensitive recording material No. 1 was prepared.

The comparative thermosensitive recording material No. 1 was subjected to the same tests as those in Example 1. The results are shown in Table 1.

COMPARATIVE EXAMPLE 2

Example 1 was repeated except that the color developing material, 1,3-di(m-chlorophenyl)thiourea, in the Liquid B employed in Example 1 was replaced by benzyl p-hydroxybenzoate, whereby a comparative thermosensitive recording material No. 2 was prepared.

The comparative thermosensitive recording material No. 2 was subjected to the same tests as those in Example 1. The results are shown in Table 1.

TABLE 1

| | Color Developing Material | Maximum Image Density | Background Density | Oil Resistance | Finger Print Resistance |
|---|---|---|---|---|---|
| Example 1 | 1,3-di(m-chlorophenyl)thiourea | 1.34 | 0.07 | o | o |
| Example 2 | 1,3-di(p-chlorophenyl)thiourea | 1.35 | 0.07 | o | o |
| Compara- | Bisphenol A | 1.33 | 0.09 | Δ | x |

TABLE 1-continued

| | Color Developing Material | Maximum Image Density | Background Density | Oil Resistance | Finger Print Resistance |
|---|---|---|---|---|---|
| tive Example 1 | | | | | |
| Comparative Example 2 | benzyl p-hydroxybenzoate | 1.32 | 0.07 | x | x |

In the above table, o indicates that the image density did not substantially change, Δ indicates that the image density slightly decreased, and x indicates that the images substantially disappeared.

As can be seen from the above results, the thermosensitive recording materials according to the present invention are excellent in the coloring performance, oil resistance and finger print resistance.

The thermosensitive recording materials according to the present invention can be employed as thermosensitive label sheets by forming an adhesive layer on the back side of the recording material and attaching a disposable backing sheet to the adhesive layer, which can be peeled off the adhesive layer when the thermosensitive recording materials are used.

As mentioned previously, the thermosensitive recording materials according to the present invention can be used in the form of an image-transfer type recording material consisting of a transfer sheet with an image-transfer layer thereon containing the above-mentioned leuco dye and an image receiving sheet with an image receiving layer thereon containing the above-mentioned color developer.

In the image-transfer type recording material, the thermosensitive coloring layer can contain either the color developer or the leuco dye, constituting the image receiving layer or the image transfer layer formed on the support material, with the image receiving layer and the support material integrally constituting an image receiving sheet or the image transfer layer and the support material integrally constituting an image transfer sheet.

The following is an example of such an image-transfer type recording material.

EXAMPLE 3

Preparation of Image Transfer Sheet

A mixture of the following components was dispersed in a ball mill for 24 hours, whereby an image transfer layer formation liquid was prepared.

| | |
|---|---|
| 3-(N—methyl-N—cyclohexylamino)-6-methyl-7-anilinofluoran | 24 g |
| methyl 4-benzoyloxybenaoate | 24 g |
| 10% aqueous solution of ethylcellulose | 38 g |
| Water | 200 g |

The thus prepared image transfer layer formation liquid was applied by a wire bar to a sheet of typewriting paper with a base weight of 15 g/m$^2$ with a deposition of the above solid components thereof in an amount of 14 g/m$^2$ when dried, whereby an image transfer sheet was prepared.

Preparation of Image Receiving Sheet

A mixture of the following components was dispersed in a ball mill for 24 hours, whereby an image receiving layer formation liquid was prepared.

| | |
|---|---|
| 1,3-di(m-chlorophenyl)thiourea | 25 g |
| 10% aqueous solution of polyvinyl alcohol | 35 g |
| Silica particles | 12.5 g |
| Water | 200 g |

The thus prepared image receiving layer formation liquid was applied to a sheet of high quality paper (35 g/m$^2$) by a wire bar, with a deposition of the solid components thereof in an amount of 6 g/m$^2$ when dried, whereby an image receiving sheet was prepared.

The image transfer sheet was superimposed on the image receiving sheet in such a manner that the image transfer layer of the image transfer sheet was in close contact with the image receiving layer of the image receiving sheet, and thermal printing was performed by a thermal head on the back side of the image transfer sheet. As a result, clear back images were formed on the image receiving sheet. The oil resistance and the finger print resistance of the thus obtained images were as excellent as those of the images obtained in Example 1.

What is claimed is:

1. A thermosensitive recording material comprising a support material and a thermosensitive coloring layer formed thereon, in which thermosensitive coloring layer, colored images are formed by the reaction between a colorless or light-colored leuco dye and a color-developer of the following formula capable of inducing color formation in said leuco dye upon application of heat thereto,

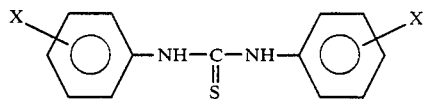

wherein X indicates halogen.

2. A thermosensitive recording material as claimed in claim 1, wherein said thermosensitive coloring layer comprises as the main components said leuco dye and said color developer.

3. A thermosensitive recording material as claimed in claim 2, wherein said thermosensitive coloring layer further comprises a binder agent, and in said thermosensitive coloring layer, the amount of said leuco dye is in the range of 5 wt. % to 30 wt. %, the amount of said color-developer is in the range of 40 wt. % to 80 wt. %, and the amount of the binder agent is in the range of 2 wt. % to 20 wt. %.

4. A thermosensitive recording material as claimed in claim 3, wherein said binder agent is selected from the group consisting of gelatin, starch, hydroxyethylcellulose, polyacrylic acid, carboxyethylcellulose, methoxycellulose, polyvinyl alcohol and polyvinyl pyrrolidone.

5. A thermosensitive recording material as claimed in claim 2, wherein the amount of the deposition of said thermosensitive coloring layer is in the range of 2 g/m$^2$ to 10 g/m$^2$.

6. A thermosensitive recording material as claimed in claim 1, wherein said thermosensitive coloring layer comprises at least two layers, with said leuco dye contained in one layer and said color-developer contained in the other layer.

7. A thermosensitive recording material as claimed in claim 1, wherein said thermosensitive coloring layer contains said color developer, constituting an image receiving layer formed on said support material, with said image receiving layer and said support material integrally constituting an image receiving sheet, and said leuco due is contained in an image transfer layer formed on another support material, constituting an image transfer layer formed on said second mentioned support material, with said image transfer layer and said second mentioned support material integrally constituting an image transfer sheet.

8. A thermosensitive recording material as claimed in claim 1, wherein said thermosensitive coloring layer contains said leuco dye, constituting an image receiving layer formed on said support material, with said image receiving layer and said support material integrally constituting an image receiving sheet, and said color developer is contained in an image transfer layer formed on another support material, constituting an image transfer layer formed on said second mentioned support material, with said image transfer layer and said second mentioned support material integrally constituting an image transfer sheet.

9. A thermosensitive recording material as claimed in claim 1, wherein said leuco dye is selected from the group consisting of triphenylmethane-type leuco compounds, fluoran-type leuco compounds, phenothiazine-type leuco compounds, auramine-type leuco compounds and spiropyran-type leuco compounds.

* * * * *